US007149470B1

(12) United States Patent
Shah et al.

(10) Patent No.: US 7,149,470 B1
(45) Date of Patent: Dec. 12, 2006

(54) DIRECT BROADCAST RECEIVER UTILIZING LNB IN CASCADE

(75) Inventors: Dipak M. Shah, Westminster, CA (US); James R. Butterworth, Palos Verdes, CA (US)

(73) Assignee: The DirecTV Group, Inc., El Segundo, CA (US)

( * ) Notice: Subject to any disclaimer, the term of this patent is extended or adjusted under 35 U.S.C. 154(b) by 615 days.

(21) Appl. No.: 10/116,266

(22) Filed: Apr. 4, 2002

(51) Int. Cl.
*H04H 1/00* (2006.01)

(52) U.S. Cl. ..... 455/3.02; 455/3.03; 455/3.04; 725/71; 725/72

(58) Field of Classification Search ..... 455/3.02, 455/303, 317, 3.03, 12.1, 427, 428, 430, 455/3.04, 311, 322, 328; 370/326; 725/68, 725/70, 72, 63, 120, 64, 78, 87; 343/840
See application file for complete search history.

(56) References Cited

U.S. PATENT DOCUMENTS

| | | | | |
|---|---|---|---|---|
| 4,592,093 | A | 5/1986 | Ouchi et al. | |
| 4,796,032 | A * | 1/1989 | Sakurai et al. | 342/359 |
| 5,301,352 | A | 4/1994 | Nakagawa et al. | |
| 5,345,591 | A | 9/1994 | Tsurumaki et al. | |
| 5,926,744 | A | 7/1999 | Fukuzawa et al. | |
| 5,940,737 | A | 8/1999 | Eastman | |
| 6,011,597 | A | 1/2000 | Kubo | |
| 6,075,970 | A | 6/2000 | Van Amesfoot | |
| 6,424,817 | B1 * | 7/2002 | Hadden et al. | 455/3.02 |
| 6,445,359 | B1 * | 9/2002 | Ho | 343/840 |
| 6,622,307 | B1 * | 9/2003 | Ho | 725/120 |
| 6,944,878 | B1 * | 9/2005 | Wetzel et al. | 725/72 |
| 2002/0150061 | A1 * | 10/2002 | Arsenault | 370/326 |
| 2003/0023978 | A1 * | 1/2003 | Bajgrowicz | 725/68 |
| 2003/0163822 | A1 * | 8/2003 | Knutson et al. | 725/68 |

* cited by examiner

*Primary Examiner*—Matthew D. Anderson
*Assistant Examiner*—Tan Trinh
(74) *Attorney, Agent, or Firm*—Georgann S. Grunebach

(57) ABSTRACT

A direct broadcast system receiving a plurality of broadcast signals within a direct broadcast receiver having an outdoor unit (ODU) is provided. The ODU includes a first low noise block (LNB) and a second LNB. The first LNB has a housing and amplifies a first broadcast signal. The second LNB amplifies a second broadcast signal. The ODU is electrically coupled to an integrated receiver and decoder (IRD). The IRD transmits a selection signal to the ODU. The first LNB and the second LNB are electrically coupled to a plurality of selection switches within the housing. The plurality of selection switches switch between the first LNB and the second LNB in response to the selection signal. A method of receiving a plurality of broadcast signals within a direct broadcast receiver is also provided.

13 Claims, 3 Drawing Sheets

DIRECT BROADCAST RECEIVER UTILIZING LNB IN CASCADE

TECHNICAL FIELD

The present invention relates generally to direct broadcast systems, and more particularly to a method and apparatus for receiving a plurality of broadcast signals within a direct broadcast system.

BACKGROUND OF THE INVENTION

Direct broadcast systems use various orbital slots, which correspond to different services including video and audio programming. Additional new services are continuously being offered for direct satellite broadcast system users. Typically when new services are offered existing direct satellite broadcast system components need to be replaced or altered to accommodate for the new services. The services are broadcasted via radio waves within the direct broadcast system.

In DBS systems both RHCP signals and LHCP signals are used to double the bandwidth of the transmitted signals and increase the capacity of the satellite. Typical direct broadcast systems include a direct broadcast receiver for receiving direct broadcast signals. The direct broadcast receiver includes a low noise block (LNB) or a series of individual separate LNBs. The LNB(s) may be directly connected to an integrated receiver and decoder (IRD) or may be connected to an external switching box followed by the IRD. The LNB(s) receive, combine, and amplify the RHCP signal and the LHCP signal. A program channel is selected on the IRD, which in turn may directly receive a direct broadcast signal having a particular frequency corresponding to the program channel from a particular LNB or may use the external switching box to switch to a different LNB. Each individual LNB is wired in parallel to the external switching box. Therefore, each additional LNB increases complexity and the number of components involved in production of the direct broadcast receiver.

Now referring to FIG. 1, a schematic view of a typical low noise block (LNB) 10 of a conventional direct broadcast receiver is shown. The LNB 10 receives broadcast signals having a RHCP signal 12 and a LHCP signal 14 through LNA 16 and LNA 18 respectively. The RHCP signal 12 and the LHCP signal 14 are 22 KHz or DC bias induced by a switching block 20. The RHCP signal 12 and the LHCP signal 14 are transferred from the LNAs 16, 18 to a power combiner circuit 22, which combines the RHCP signal 12 and the LHCP signal 14 to form a combined signal 24. The combined signal 24 is amplified by a radio frequency (RF) amplifier 26. After amplification the combined signal 24 is differentiated by a mixer 28 and an oscillator 30 to form an intermediate frequency (IF) signal 32. The oscillator 30 feeding the mixer 28 usually has a frequency of about 11.25 GHz. Conventional direct broadcast receivers having more than one LNB have different frequency components for each LNB corresponding to each different service. The differential between the broadcast signal frequencies and the frequency of the oscillator 30 provides the frequency of the intermediate signal 32. With the bandwidth of the broadcast signals being 500 MHz, the output intermediate frequency for the LNB(s) is usually in the range of 950–1450 MHz. The IF signal 32 is amplified by an IF amplifier 34 and transferred to the IRD. The IF signals are more conductive to transmission by means of a less expensive transmission wire or conduit, such as a simple coaxial cable.

Another LNB that has been considered for use in direct broadcast receivers, is a stacked LNB. The stacked LNB decodes a LHCP signal and a RHCP signal simultaneously. A direct broadcast receiver using stacked LNB uses one LNB for the lower frequency range of 950–1450 MHz and another LNB for a higher frequency range of 1525–2050 MHz. Either the LHCP signal or the RHCP signal is shifted from the lower frequency range to the higher frequency range so as to decode both simultaneously. The use of stacked LNB allows a direct broadcast receiver to facilitate more than two IRDs by signal splitting using an appropriately rated splitter.

New direct broadcast services are continually being offered resulting in new orbital slots. In order to accommodate for the new orbital slots the existing ODUs and the IRDs are typically replaced or altered. The replacement of the ODUs and IRDs is costly and time consuming. Therefore, it is desirable to develop a direct broadcast system that is able to accommodate for new services without the need for changing components within the direct broadcast system.

It would also be desirable to minimize the number of components within a direct broadcast system while maintaining the ability to switch between multiple LNBs, reduce wiring requirements for signal distribution, and thereby reducing costs.

SUMMARY OF THE INVENTION

The forgoing and other advantages are provided by a method and apparatus of receiving a plurality of broadcast signals within a direct broadcast receiver. A direct broadcast system having a high altitude communication device transmits a plurality of broadcast signals and a direct broadcast receiver receives the plurality of broadcast signals is provided. The direct broadcast receiver includes an antenna electrically coupled to an outdoor unit (ODU). The ODU includes a waveguide electrically coupled to the antenna. The waveguide separates out of the plurality of broadcast signals a first broadcast signal and a second broadcast signal. The waveguide is electrically coupled to a first low noise block (LNB) and a second LNB. The first LNB has a housing and amplifies the first broadcast signal. The second LNB amplifies the second broadcast signal. The ODU is electrically coupled to an integrated receiver and decoder (IRD). The IRD transmits a selection signal to the ODU. The first LNB and the second LNB are electrically coupled to a plurality of selection switches within the housing. The plurality of selection switches switch between the first LNB and the second LNB in response to the selection signal.

The present invention also provides a method of receiving a plurality of broadcast signals within a direct broadcast receiver having a first LNB, a second LNB, and a plurality of IRDs. The method includes determining a direct broadcast service having a corresponding selection signal. The selection signal is transmitted to an outdoor unit. The ODU switches between the first LNB and the second LNB in response to the selection signal.

The present invention has several advantages over existing direct broadcast systems. One advantage of the present invention is that switching between LNBs is performed within the ODU, thereby, decreasing system components, reducing the complexity of wiring for signal distribution, and reducing costs in production and implementation of a direct broadcast receiver.

Yet another advantage of the present invention is that service additions are easily accomplished without the need to change direct broadcast receiver components or existing wiring, this saves additional costs.

The present invention itself, together with further objects and attendant advantages, will be best understood by reference to the following detailed description, taken in conjunction with the accompanying drawing.

BRIEF DESCRIPTION OF THE DRAWING

For a more complete understanding of this invention reference should now be had to the embodiments illustrated in greater detail in the accompanying figures and described below by way of example.

DETAILED DESCRIPTION OF THE PREFERRED EMBODIMENT

Figure 1:
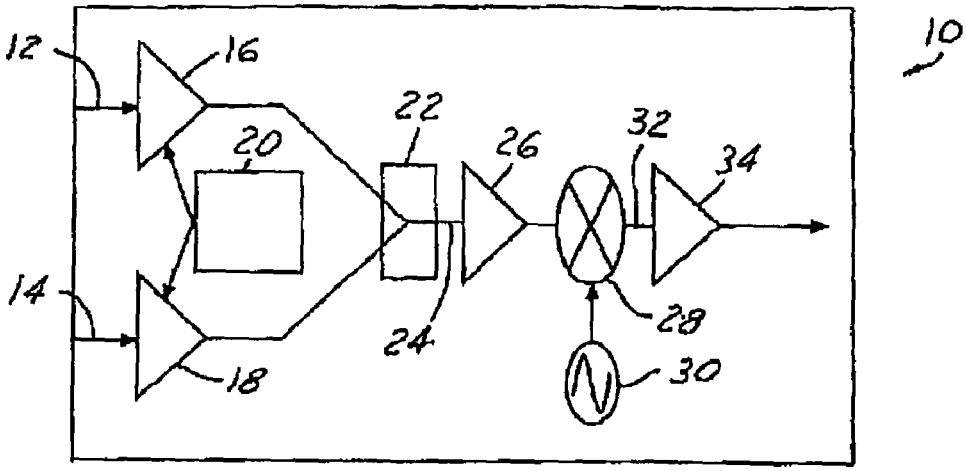
FIG. 1 (PRIOR ART)
FIG. 1 is a schematic view of a typical low noise block (LNB) of a conventional direct broadcast receiver.

While the present invention is described with respect to a method and apparatus for receiving a plurality of broadcast signals within a direct broadcast system, the following method is capable of being adapted for various purposes and is not limited to the following applications: direct broadcast systems, cable television networks, communication systems, or other terrestrial communication applications.

In the following figures the same reference numerals are used to refer to the same components. Also in the following description, various operating parameters and components are described for one constructed embodiment. These specific parameters and components are included as examples and are not meant to be limiting.

Figure 2:
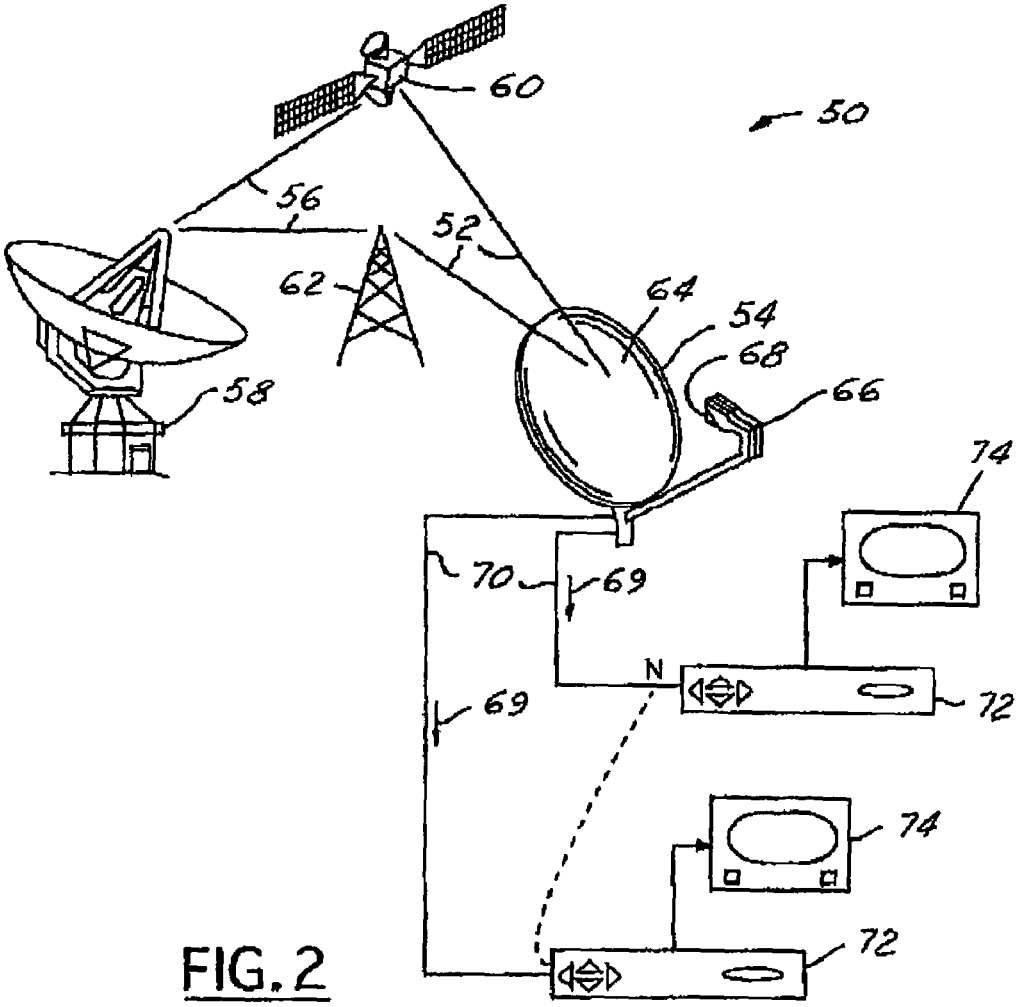
FIG. 2 is a perspective view of a direct broadcast system, utilizing a method and apparatus for receiving a plurality of broadcast signals within a direct broadcast receiver according to the present invention.

Now referring to FIG. 2, a perspective view of a direct broadcast system 50, utilizing a method and apparatus for receiving a plurality of broadcast signals 52 within a direct broadcast receiver 54 according to the present invention. Radio frequency (RF) signals 56 are transmitted at one particular frequency from a ground based station 58 to a high altitude device 60. Device 60 transmits the RF signals 56 at a different frequency forming direct broadcast signals 52. Device 60 may be a satellite, a stratospheric platform or other communication device. Although the present invention utilizes a device 60 a base tower 62 may also be used to receive and transmit RF signals 56. The direct broadcast signals 52 are received by a parabolic antenna 64 with a direct broadcast receiver 54. The parabolic antenna 64 focuses the direct broadcast signals 52 to an outdoor unit (ODU) 66 located at a focal point of the antenna 64. The ODU 66 receives the direct broadcast signals 52 via a waveguide 68. The ODU 66 converts the direct broadcast signals 52 into intermediate frequency (IF) signals 69, which are transferred by coaxial cables 70 to, integrated receivers and decoders (IRDs) 72. The IRDs 72 decode the programming on the IF signals 69 for visual display on monitors 74. The IF signals 69 are more conductive to transmission by means of a less expensive transmission wire or conduit, such as the coaxial cable 70. The IF signals 69 contain all the audio and video programming as well as the data provided in direct broadcast transmission. The direct broadcast system 50 may have N number of IRDs 72 and monitors 74 in parallel.

Figure 3:
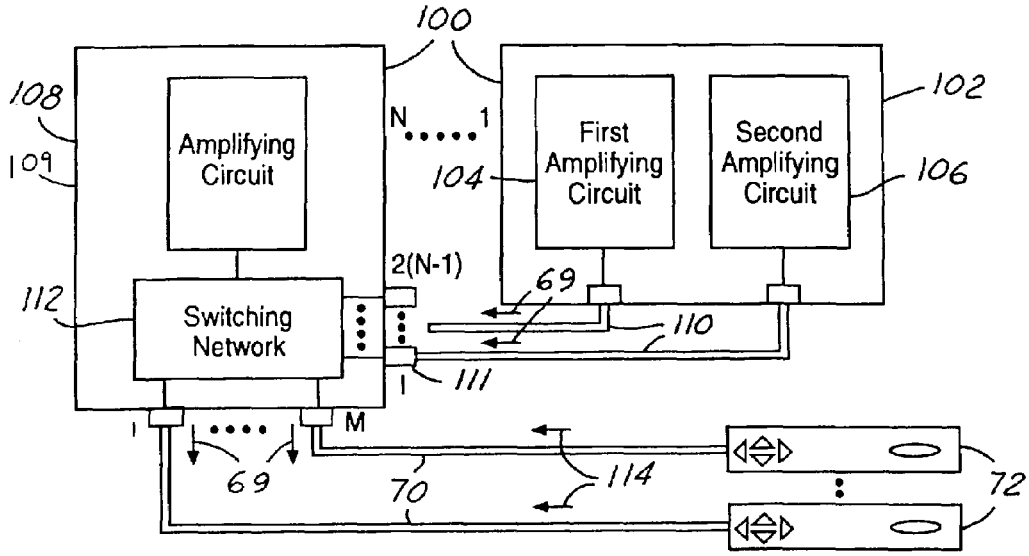
FIG. 3 is a block diagrammatic view of a series of single LNBs in combination with a series of IRDs in accordance with an embodiment of the present invention.

Now referring also to FIG. 3, a block diagrammatic view of a series of LNBs 100 in combination with a series of IRDs 72 is shown in accordance with an embodiment of the present invention. The LNB 100 transfer direct broadcast signals through a LNB in LNB 100 to the IRDs 72. Although, the LNB 100 are shown as part of a single ODU 66, the LNB 100 may be connected to multiple ODUs. The waveguide 68 transfers a direct broadcast signal to a LNB, of LNBs 100, which accepts frequency corresponding to the frequency of a direct broadcast service. A dual LNB 102 is shown having a first amplifying circuit 104 and a second amplifying circuit 106. The Nth LNB 108 has a housing 109, which at least partially contains a switching network 112 for switching between LNBs 100. The housing may be of various form, size, and style. The LNBs, 1 through 2*(N−1), transfer signals 69 via coaxial cable 110 through connections 111 to switching network 112. The IF signals 69 are transferred from the LNBs 100 through the switching network 112 to a series of IRDs 72. The IRDs 72 determine the direct broadcast service to be viewed on the monitors 74.

Although the LNBs 100 are illustrated as separate individual components, the LNBs 100 may be part of an integrated or solid-state electrical component mounted within a housing. Extra or spare LNBs may be provided in the series of LNBs 100 to accommodate for new services. The LNBs 100 may be frequency adjustable to also accommodate for new services or changes to existing services. The LNBs 100 are mounted within the ODU 66. Although the LNB 100 are shown as single LNB, they may be single LNB, dual LNB, stacked LNB, or other LNB or a combination thereof. Each LNB 100 has a different frequency range corresponding to an orbital slot, which in turn corresponds to a particular direct broadcast service.

The IRDs 72 transmit a dc/frequency tone selection signal 114 to the switching network 112 in response to a program channel selected on each IRD 72, which in turn selects the LNB 100 to receive the selection signals 114 corresponding to a direct broadcast service. The selection signal may be control frequency, a multi-level control voltage, a "strobbed" or pulsed control voltage, or other form of control voltage. The ODU 66 may have an electronic control device (not shown) to decode all polarized selection information within the selection signal 114 and control the switching network 112. The electronic control device may be CPU based. The IRDs 72 may also be reprogrammed to create additional selection signals, thereby accommodating for new services or changes to existing services.

Figure 4:
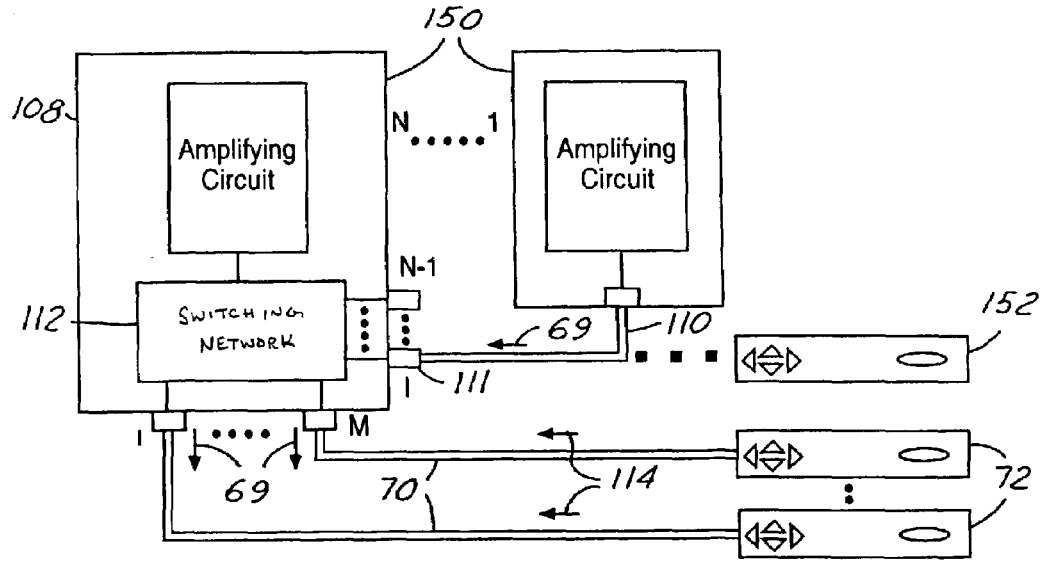
FIG. 4 is a block diagrammatic view of stacked LNB in combination with a series of IRDs in accordance with an embodiment of the present invention.

Now referring also to FIG. 4, a block diagrammatic view of stacked LNB 150 in combination with a series of IRDs 72 according to an embodiment of the present invention is shown. The LNB 150 as stated above may be single LNB, dual LNB, stacked LNB, or other LNB. The LNB 150 receive and transfer the broadcast signals 52 to the switching network 112 located within the Nth LNB 108. The switching network 112 receives selection signals 114 from and transfers broadcast signals to the series of IRDs 72. IRDS 72 may also be directly connected to the LNB 150 when only one direct broadcast service is desired for a particular monitor 74, as shown by IRD 152. The switching network 110 transfers the IF signals 69 to the IRDs 72.

Figure 5A:
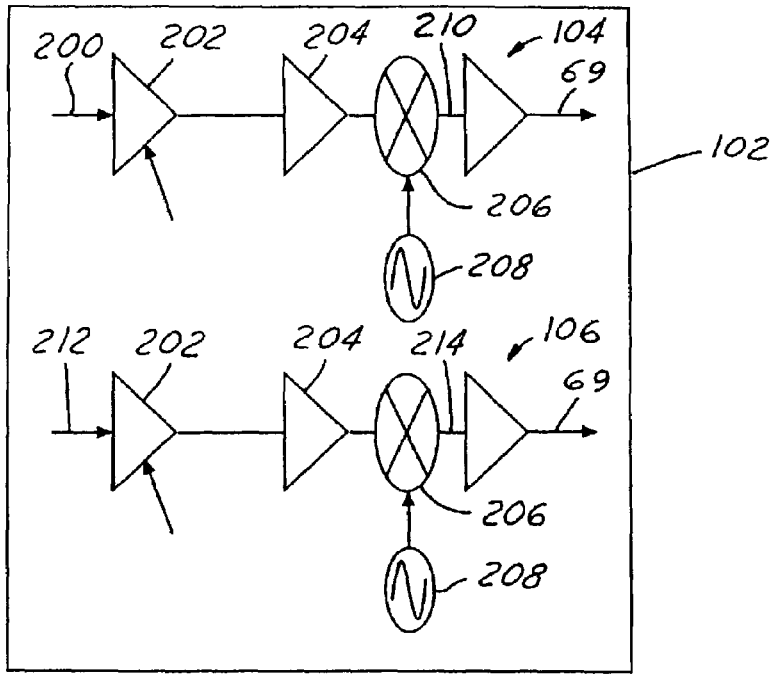
FIG. 5A is a schematic view of a first amplifying circuit and a second amplifying circuit within a dual LNB according to the present invention.

Now referring to FIG. 5A, a schematic view of the first amplifying circuit 104 and the second amplifying circuit 106 within the LNB 102 according to the present invention is shown. The waveguide 68 receives broadcast signals 52, which may be polarized signals. The polarized signals may be separated by waveguide 68 into right hand circular polarized (RHCP) signals and left-hand circular polarized (LHCP) signals. Although the present invention is described as receiving RHCP signals and LHCP signals other polarized signals such as horizontal signals and vertical signals may be received by the present invention. The first amplifying circuit 104 receives a first broadcast signal 200 or a RHCP signal 200 and amplifies the signal using a LNA 202. The RHCP signal 200 maybe 22 KHz or DC bias induced within LNA 202. The signal 200 is transferred from the LNA 202 to a RF amplifier 204. Signal 200 is differentiated by a mixer 206 and an oscillator 208. The resulting signal 210 is amplified by an IF amplifier 211 to form one of the IF signals 69 and transferred to one of the IRDs 72. The second amplifying circuit 106 has the same or similar components and performs the same or similar functions as the first amplifying circuit 104. The second amplifying circuit 106 converts a second broadcast signal 212 or LHCP signal to a second resulting signal 214.

Figure 5B:
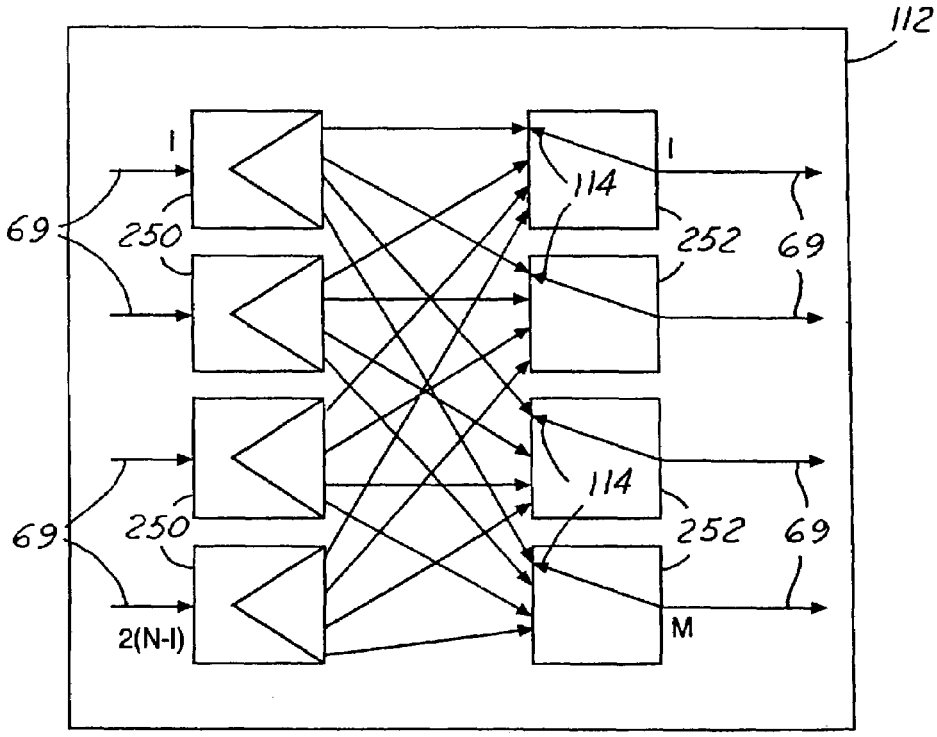
FIG. 5B is a schematic view of a switching network within a LNB in accordance with the present invention.

Now referring also to FIG. 5B, a schematic view of the switching network 112 within a LNB 100 according to the present invention is shown. The IF signals 69, are transferred to a plurality of splitters 250. Splitters 250 transfer the IF signals 69 to selection switches 252. The splitters 250 may transfer signals from multiple and different LNB of LNB 100. The selection switches 252 may be integrated or solid-state components. Each selection switch 254 has the ability to switch between splitters 250. The selection switches 252 may have the ability to switch between all splitters 250 or a predetermined amount of splitters 250. The IRDs 72 transfer the selection signals 114 to the ODU 66, which then selects a selection switch position for the corresponding selection switch 254. The ODU 66 may have an electronic control device to enable the switching between selection switches 254. The IRDs 72 instead of the ODU 66 may control the switches 252 to switch between LNBs 100. After the selection switch is positioned direct broadcast signals are transferred through one of the LNBs of LNBs 100, one splitter of splitters 250, a selection switch 254, to the appropriate IRD of IRD 72.

A method of receiving a plurality of broadcast signals 52 within a direct broadcast system 50 according to the present invention as follows.

In a first step, an operator selects a program channel on an IRD 72. The program channel represents a direct broadcast service that is desired by the operator. The direct broadcast service is directly related to a LNB of LNB 100 and a satellite orbit slot. The IRD 72 may determine a polarized signal to receive using digital communication, analog communication, or a combination thereof. The selection signal transfers information corresponding to the determined polarized signal to the IRD 108 to switch to the appropriate LNB in LNB 100.

In a next step, the IRD 72 generates a selection signal 114 and transfers the selection signal 114 to the Nth LNB 108 or the ODU 66 which controls the switches 252.

In another step, the ODU 66 switches between the LNBs 100 in response to the selection signal 114 allowing the selected broadcast service to be transferred to the IRD 72 followed by displaying on a monitor 74.

The present invention provides a method of receiving a plurality of broadcast signals within a direct broadcast receiver and therein switching between LNBs using the ODU, thereby, decreasing system components, reducing the complexity of wiring for signal distribution, and reducing costs in production and implementation of a direct broadcast receiver.

The above-described method, to one skilled in the art, is capable of being adapted for various purposes and is not limited to the following applications: direct broadcast systems, cable television networks, communication systems, or other terrestrial communication applications. The above-described invention may also be varied without deviating from the true scope of the invention.

What is claimed is:

1. A direct broadcast system having a high altitude communication device transmitting a plurality of broadcast signals and an antenna receiving said plurality of broadcast signals comprising:

an outdoor unit (ODU) electrically coupled to said antenna comprising;

a waveguide electrically coupled to said antenna, said waveguide separating a first broadcast signal and a second broadcast signal from said plurality of broadcast signals;

a first low noise block (LNB) having a housing and electrically coupled to said waveguide, said first LNB amplifying said first broadcast signal; and a second LNB electrically coupled to said waveguide, said second LNB amplifying said second broadcast signal;

an integrated receiver and decoder (IRD) electrically coupled to said ODU, said IRD transmitting a selection signal to said ODU; and a plurality of selection switches located within said housing and electrically coupled to said first LNB, said second LNB, and said IRD, said plurality of selection switches switching between said first LNB and said second LNB in response to said selection signal.

2. A system as in claim 1 further comprising an integrated LNB unit comprising said first LNB and said second LNB.

3. A system as in claim 1 wherein said first LNB comprises said plurality of selection switches.

4. A system as in claim 3 further comprising a splitter electrically coupled to said first LNB and said plurality of selection switches, said splitter transferring said first broadcast signal to said plurality of selection switches.

5. A system as in claim 1 comprising:

said high altitude communication device having an orbital slot; and said IRD transmitting a selection signal corresponding to said orbital slot;

wherein said ODU controlling said plurality of selection switches selects between said first LNB and said second LNB in response to said selection signal.

6. A system as in claim 1 wherein said IRD has the ability to be programmed to support a plurality of orbital slots.

7. A system as in claim 1 further comprises:

said first LNB comprising;

a first amplifying circuit amplifying said first broadcast signal; and a second amplifying circuit amplifying said second broadcast signal;

wherein said plurality of selection switches switching between said first amplifying circuit and said second amplifying circuit.

8. A system as in claim 7 comprising:

said waveguide separating said first broadcast signal into a first polarized signal and a second polarized signal;

said first amplifying circuit amplifying said first polarized signal; and said second amplifying circuit amplifying said second polarized signal;

wherein said IRD in controlling said plurality of selection switches switching between said first amplifying circuit and said second amplifying circuit in response to said selection signal.

9. A system as in claim 1 wherein said ODU further comprises an electronic control device for receiving a selection signal and controlling said plurality of selection switches in response to said selection signal.

10. A direct broadcast receiver having an antenna receiving a plurality of broadcast signals, electrically coupled to an integrated receiver and decoder (IRD), and comprising:

an outdoor unit (ODU) electrically coupled to said antenna comprising:

a waveguide electrically coupled to said antenna separating said plurality of broadcast signals to form a first broadcast signal and a second broadcast signal;

a low noise block (LNB) having a housing electrically coupled to said waveguide comprising;

a first amplifying circuit amplifying said first broadcast signal; and a second amplifying circuit amplifying said second broadcast signal; and an integrated plurality of selection switches located within said housing and electrically coupled to said first amplifying circuit, said second amplifying circuit, and the IRD;

said ODU controlling said integrated plurality of selection switches to switch between said first amplifying circuit and said second amplifying circuit in response to a selection signal generated and transmitted from the IRD.

11. A system as in claim 10 wherein said IRD has the ability to be programmed to support a plurality of orbital slots.

12. A system as in claim 10 wherein said ODU further comprises an electronic control device for receiving a selection signal and controlling said selection switch in response to said selection signal.

13. A system as in claim 10 wherein said first LNB comprises said plurality of selection switches.

* * * * *